US007872950B1

(12) United States Patent
Su

(10) Patent No.: US 7,872,950 B1
(45) Date of Patent: Jan. 18, 2011

(54) TIME DISPLAY DEVICE AND METHOD THEREOF

(75) Inventor: Xiao-Guang Su, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/650,421

(22) Filed: Dec. 30, 2009

(30) Foreign Application Priority Data

Sep. 22, 2009 (CN) ..... 2009 1 0307455

(51) Int. Cl.
*G04B 19/00* (2006.01)

(52) U.S. Cl. ..... 368/76; 368/223

(58) Field of Classification Search ..... 368/76, 368/79, 223, 239
See application file for complete search history.

(56) References Cited

U.S. PATENT DOCUMENTS 2,290,278 A * 7/1942 Failla ..... 368/234
2,351,238 A * 6/1944 Teuber ..... 368/223
2,534,877 A * 12/1950 Owen ..... 368/79
3,430,433 A * 3/1969 Sandor ..... 368/80
3,983,688 A * 10/1976 Kockinos ..... 368/24
4,034,549 A * 7/1977 Danley et al. ..... 368/79
4,177,634 A * 12/1979 Calienes ..... 368/232
4,374,623 A * 2/1983 Simon ..... 368/79
4,461,581 A * 7/1984 Simon ..... 368/79
4,666,310 A * 5/1987 Snapka ..... 368/24
4,761,715 A * 8/1988 Brooks ..... 362/23
5,247,491 A * 9/1993 Kwiatkowski ..... 368/79
6,160,767 A * 12/2000 Ho ..... 368/79
6,219,306 B1 * 4/2001 Kwiatkowski ..... 368/223
6,363,036 B1 * 3/2002 Siepmann ..... 368/113
6,690,623 B1 * 2/2004 Maano ..... 368/82
7,388,813 B2 * 6/2008 Su ..... 368/79

* cited by examiner

*Primary Examiner*—Vit W Miska
*Assistant Examiner*—Sean Kayes
(74) *Attorney, Agent, or Firm*—Frank R. Niranjan

(57) ABSTRACT

A time display device and a time display method are provided. The time display method implemented by the time display device, the method comprising, providing a current time information; controlling the first stepper motor to drive the light source to rotate an angle, then the emitted light representing as an hour hand; determining the current emitted reflector according to hour value in the second time information; determining a rotation angle of the reflector according to hour value, minute value in the second time information and a calculation formula; and controlling the second stepper motor group to drive the reflector to rotate the rotation angle, thus emitted light reflected by the reflector points to a corresponding minute marker, the reflected light representing as a minute hand.

8 Claims, 4 Drawing Sheets

TIME DISPLAY DEVICE AND METHOD THEREOF

BACKGROUND

1. Technical Field

The present disclosure relates to a time display device and a time display method for the device.

2. Description of Related Art

Many analog clock faces include hour, minute, and second hands and markings. The typical arrangement of those hands may not be so interesting to people anymore.

DETAILED DESCRIPTION

Figure 1:
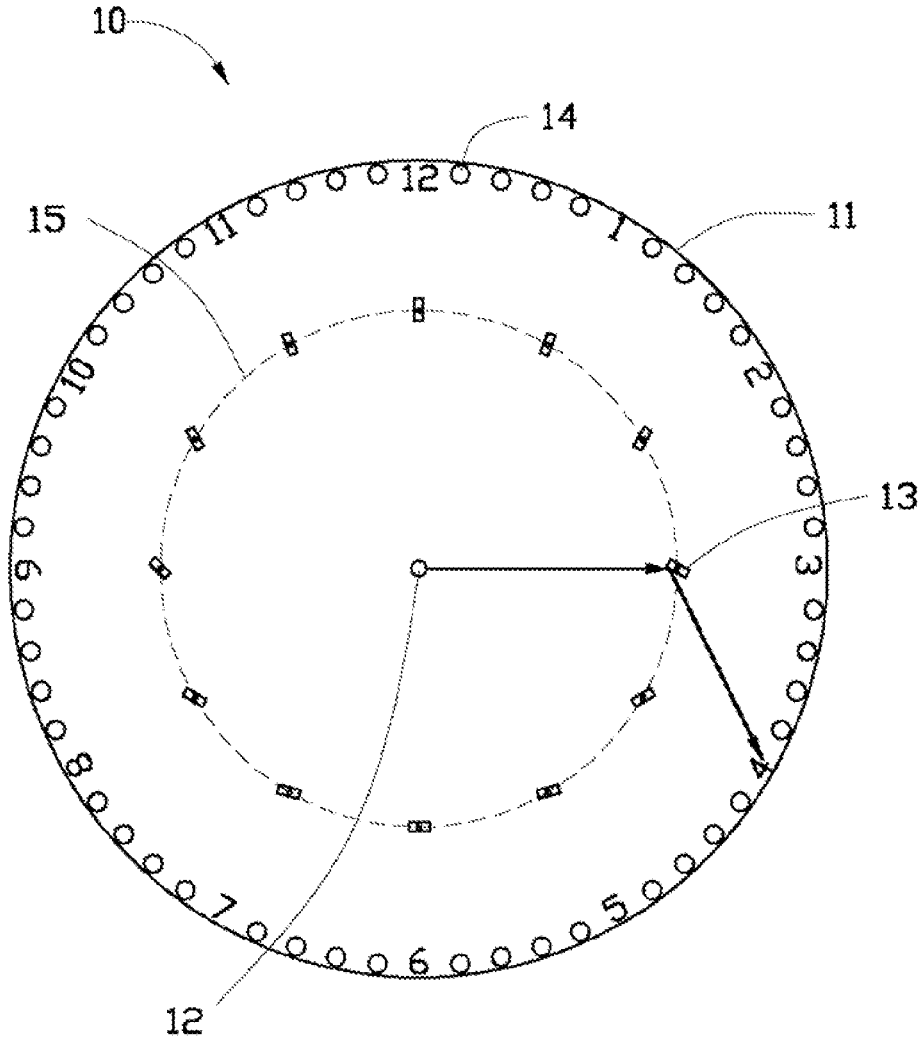
FIG. 1 is a schematic view of a time display device in accordance with an exemplary embodiment.

FIG. 1 is a schematic view of a time display device 10 in accordance with an exemplary embodiment. The time display device 10 includes a round dial plate 11, a light source 12, and a plurality of reflectors 13 set on the dial plate 11. The light source 12 is used to emit light that can be seen as hands of a clock to replace standard clock hands for a novel attractive appearance.

There are pluralities of markers 14 set on the dial plate 11 to indicate time, including markers for hours, minutes.

The light source 12 is set in center of the dial plate 11, and is configured to emit visible light to an hour marker. In the exemplary embodiment, the light source 12 is a laser.

The reflectors 13 each aligned with one of the twelve hour markers and the light source, and configured to reflect light from the light source 12. Please note that in this embodiment a 12 hour clock face is represented may be otherwise in alternative embodiments. There are twelve reflectors 13 set evenly on a virtual circle 15 coaxial to the dial plate 11.

The light source 12 emits light to a reflector 13 corresponding to hour of current time. Light is reflected by the reflector 13 to a marker 14 corresponding to minute of current time. As shown in FIG. 1, the visible color light can read as the current time of 3:20.

Figure 2:
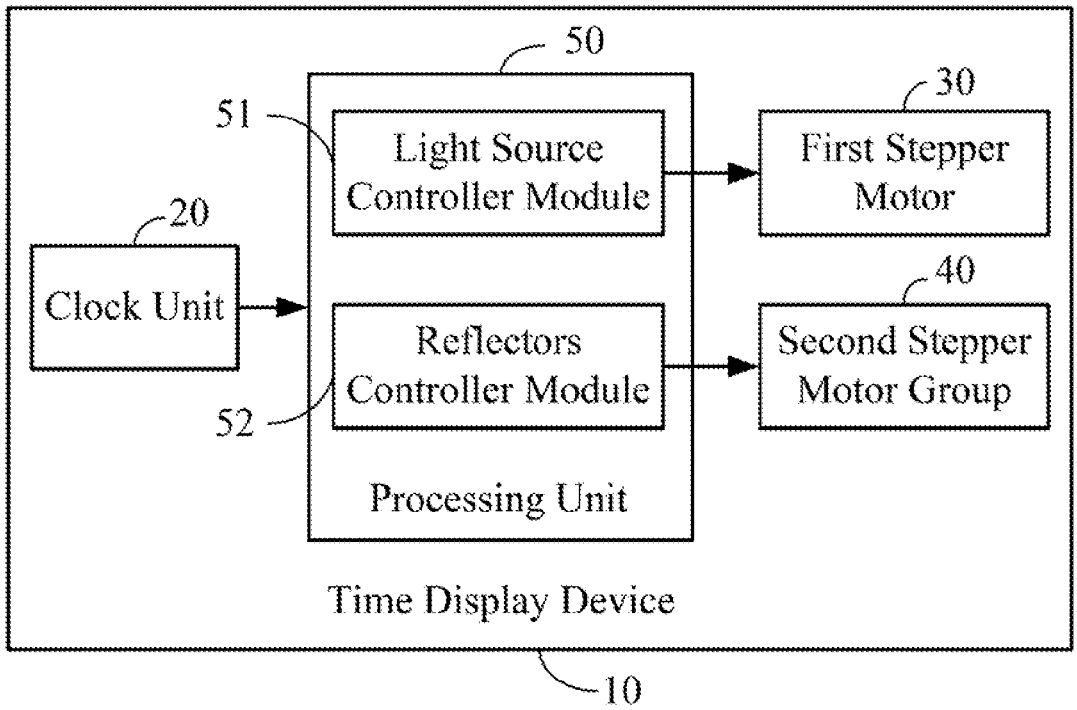
FIG. 2 is a block diagram of the hardware infrastructure of the time display device of FIG. 1 in accordance with an exemplary embodiment.

FIG. 2 is a block diagram of the hardware infrastructure of the time display device of FIG. 1 in accordance with an exemplary embodiment. The time display device 10 includes a clock unit 20, a first stepper motor 30, a plurality of second stepper motor group 40, and a processing unit 50.

The clock unit 20 is configured to send a first time information to the processing unit 50 when an hour has elapsed, and a second time information to the same when a minute has elapsed. The first time information is an hour value of the current time. The second time information includes both the hour and minute value of the current time.

The first stepper motor 30 is configured to drive the light source 12 to rotate under the control of the processing unit 50 to change an emitting direction at the same time. The second stepper motor group 40 is configured to drive the reflectors 13 to rotate under the control of the processing unit 50 to change the reflection direction simultaneously. The first stepper motor 30 and the second motor unit 40 are both set behind the dial plate 11 (unshown). The first stepper motor 30 includes only one stepper motor to drive the light source 12 to rotate; the second stepper motor group 40 includes twelve stepper motors, each of which drives the corresponding reflector 13 to rotate.

The processing unit 50 includes a light source controller module 51 and a reflectors controller module 52. The light source controller module 51 is configured to acquire the hour value in the first time information from the clock unit 20, and drive the first stepper motor 30 to rotate, the reflectors 13 are set at the direction of emitted light, the emitted light being incident on a corresponding reflector 13 represents as an hour hand. For example, when an hour has elapsed, the light source 20 rotates 30-degree angle under driving of the light source controller module 51, then the emitting direction also rotates 30-degree angle and the emitted light being incident on another reflector 13 corresponding to the new hour value.

The reflector controller module 52 is configured to determine the corresponding reflector 13 according to the hour value in the second time information, and drive the corresponding reflector 13 to rotate correspondingly direction according to the hour and minute value in the second time information, such that the reflector 13 reflects light points a correspondingly minute marker. For example, when a minute has elapsed, the reflector 13 rotates correspondingly direction under the driving of the second stepper motor group 40, and the reflector 13 reflects light points the correspondingly minute marker.

In another exemplary embodiment, the second time information only includes the minute value. The reflector controller module 52 acquires the hour value from the light source controller module 51, and determines the current emitted reflector 13.

Figure 3:
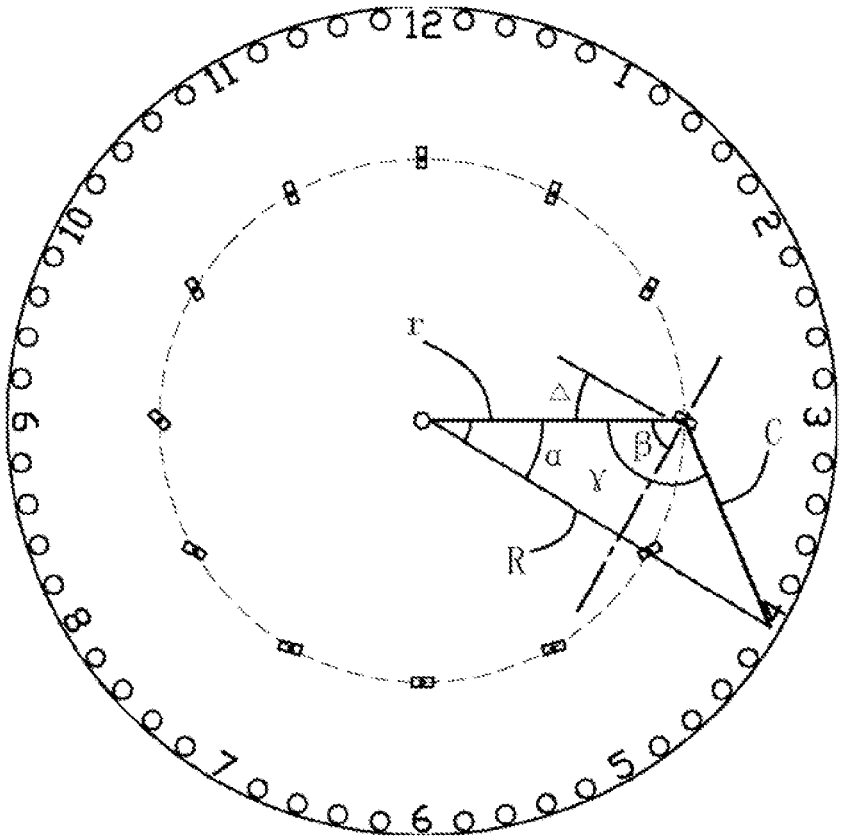
FIG. 3 is another schematic diagram of the time display device of FIG. 1.

FIG. 3 is another schematic diagram of the time display device of FIG. 1. In particular, the method of determining the rotation angle of the reflector 13 is: supposed that the current time is m:n, distance from the center of dial plate 11 to the center of a reflector is r, distance from the center of dial plate 11 to markers 14 is R, distance from the center of reflectors 13 to markers 14 is C, angle between the r and the R is $\alpha$, angle between the r and the C is $\gamma$, angle $\beta$ of incidence is $\gamma/2$, angle between two adjacent markers 14 is 6 degree, and angle between centers of two adjacent reflectors 13 is 30 degree, then the $\alpha$ is equals to $|6n-30m|$. A triangle which is made up of r, R and C, $R^2+r^2-C^2$ is equal to $2rR*\cos\alpha$ according to cosine theorem, then the C is equal to $\sqrt{R^2+r^2-2rR*\cos|6n-30m|}$; $R/\sin\gamma$ is equal to $C/\sin\alpha$ according to sine theorem, then $\sin\gamma$ is equal to $(R*\sin\alpha)/C$ and also is equal to $(R*\sin|6n-30m|)/C$, $\gamma$ is equal to $\arcsin(R*\sin|6n-30m|)/\sqrt{R^2+r^2-2rR*\cos|6n-30m|}$, the angle $\beta$ of incidence is $0.5*\arcsin(R*\sin|6n-30m|)/\sqrt{R^2+r^2-2rR*\cos|6n-30m|}$, rotation angle $\Delta$ between the emitted light and the reflector 13 is equal to $90-0.5*\arcsin(R*\sin|6n-30m|)/\sqrt{R^2+r^2-2rR*\cos|6n-30m|}$. Then when a minute has elapsed, the reflector controller modules 52 determines value of the rotation angle $\Delta$ according to the value m of hour time and the value n of minute time, and then the second stepper motor group 40 drives the reflector 13 to rotate to the corresponding rotation angle $\Delta$.

Figure 4:
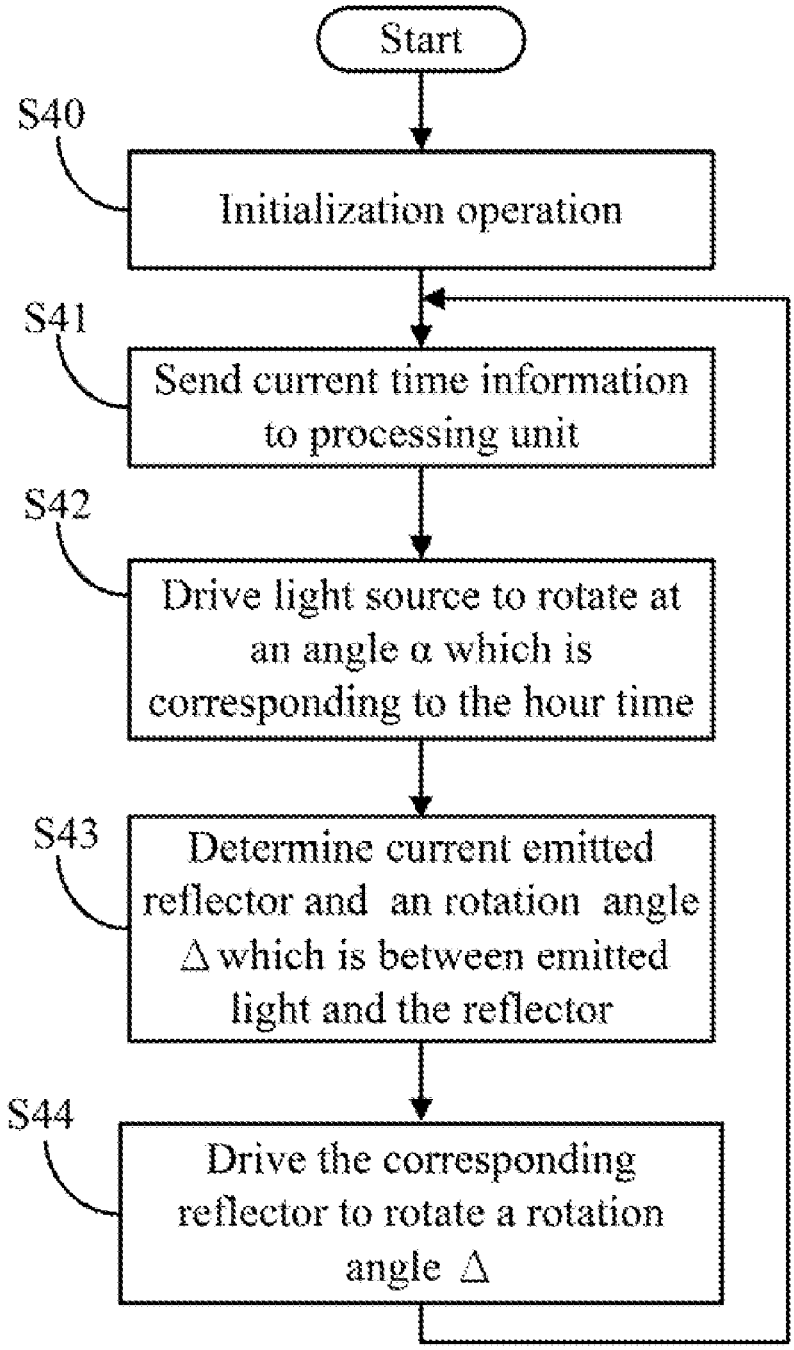
FIG. 4 is a flowchart of a time display method implemented by the time display device of FIG. 1, in accordance with an exemplary embodiment.

FIG. 4 is a flowchart of a time display method implemented by the time display device of FIG. 1, in accordance with an exemplary embodiment.

In step S40, at initial state, the reflectors controller module 52 determines twelve rotation angles Δ according to twelve hour values, then the second stepper motor group 40 drives the corresponding reflector 13 to rotate a rotation angle Δ in turn, that way, each reflector 13 points the whole time in the initial state.

In step S41, the clock unit 20 sends a first time information to the processing unit 50 when an hour has elapsed, and send a second time information to the processing unit 50 when a minute has elapsed.

In step S42, the light source controller module 51 controls the first stepper motor 30 to drive the light source to rotate an angle α in clockwise direction, then the emitted light emit to a corresponding reflector 13.

In step S43, the reflector controller module 52 determines the emitted reflector 13 according to the hour value in the second time information, and determines the rotation angle Δ which is between the emitted light and the reflector 13.

In step S44, the reflector controller module 52 sends value of rotation angle Δ to corresponding second stepper motor group 40, then the second stepper motor group 40 drives the corresponding reflector 13 to rotate a rotation angle Δ, thus the emitted light reflected by the reflector 13 points the corresponding minute marker.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A time display device comprising:

a dial plate;

a plurality of markers set on the dial plate to indicate time, the plurality of markers comprising markers for hours and minutes;

a clock unit configured to send a first time information when an hour has elapsed, and a second time information when a minute has elapsed;

a light source set in center of the dial plate, and configured to emit visible light to an hour marker;

a plurality of reflectors each aligned with one of the hour markers and the light source, and configured to reflect the light from the light source;

a first stepper motor configured to drive the light source to rotate;

a second stepper motor group configured to drive the reflectors to rotate; and a processing unit configured to control the first stepper motor to drive the light source to rotate according to the first time information, and configured to control the second stepper motor group to drive the reflectors to rotate according to the second time information, wherein the emitted light of the light source being emitted to a corresponding reflector represents as an hour hand, and the reflected light by the reflector pointing to a corresponding minute marker represents as an minute hand.

2. The time display device as claim 1, wherein, the first time information comprises an hour value of the current time, the plurality of markers comprises twelve hour markers, the number of the plurality of reflectors is twelve and the second stepper motor group comprises twelve second stepper motors corresponding to the twelve hour markers; the processing unit comprises a light source controller module, the light source controller module being configured to acquire hour value in the first time information from the clock unit, and drive the first stepper motor to rotate in clockwise, so that the emitted light being incident on a reflector which corresponding to the hour of current time.

3. The time display device as claim 1, wherein the second time information comprises both an hour and a minute value, the processing unit further comprises a reflector controller module, the reflector controller module configured to determine the current emitted reflector according to hour value in the second time information, and drive the reflector to rotate a rotation angle Δ according to hour value, minute value in the second time information and a calculation formula, so that the emitted light which reflected by the reflector points a corresponding minute of current time.

4. The time display device as claim 3, wherein the calculation formula is that the rotation angle Δ between the emitted light and the reflector is equal to $90-0.5*\arcsin(R*\sin|6n-30m|)/\sqrt{R^2+r^2-2rR*\cos|6n-30m|}$, wherein the m is the hour value of the current time in twelve hours shift, the n is the minute value of the current time in twelve hours shift, the r is the distance from the center of dial plate to the center of a reflector, the R is the distance from the center of dial plate to markers, the C is the distance from the center of reflectors to markers, the α is an angle between the r and the R, the γ is an angle between the r and the C, the α is equal to |6 n−30m|.

5. The time display device as claim 1, wherein the reflectors set evenly on a virtual circle coaxial to the dial plate.

6. The time display device as claim 1, wherein the emitted light of the light source is a laser.

7. A time display method implemented by a time display device, which comprises a dial plate; a plurality of markers set on the dial plate; a clock unit; a light source; a plurality of reflectors; a first stepper motor; a second stepper motor group and a processing unit; the method comprising:

providing a current time information;

controlling the first stepper motor to drive the light source to rotate an angle, then the emitted light representing as an hour hand;

determining the current emitted reflector according to hour value in the second time information;

determining a rotation angle of the reflector according to hour value, minute value in the second time information and a calculation formula; and controlling the second stepper motor group to drive the reflector to rotate the rotation angle, thus emitted light reflected by the reflector points a corresponding minute marker, the reflected light representing as a minute hand.

8. The time display method as claim 7, wherein the calculation formula is that the rotation angle Δ between the emitted light and the reflector is equals to $90-0.5*\arcsin(R*\sin|6n-30m|)/\sqrt{R^2+r^2-2rR*\cos|6n-30m|}$, wherein the m is the hour value of the current time in twelve hours shift, the n is the minute value of the current time in twelve hours shift, the r is the distance from the center of dial plate to the center of a reflector, the R is the distance from the center of dial plate to markers, the C is the distance from the center of reflectors to markers, the α is an angle between the r and the R, the γ is an angle between the r and the C, the α is equal to |6n−30m|.

* * * * *